US009595226B2

(12) United States Patent
Qing et al.

(10) Patent No.: US 9,595,226 B2
(45) Date of Patent: Mar. 14, 2017

(54) PIXEL CIRCUIT FOR AC DRIVING, DRIVING METHOD AND DISPLAY APPARATUS

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Haigang Qing, Beijing (CN); Xiaojing Qi, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan Province (CN)

( * ) Notice: Subject to any disclaimer, the term of this patent is extended or adjusted under 35 U.S.C. 154(b) by 0 days.

(21) Appl. No.: 14/428,504

(22) PCT Filed: Jul. 30, 2014

(86) PCT No.: PCT/CN2014/083351

§ 371 (c)(1),
(2) Date: Mar. 16, 2015

(87) PCT Pub. No.: WO2015/062322

PCT Pub. Date: May 7, 2015

(65) Prior Publication Data

US 2015/0287359 A1 Oct. 8, 2015

(30) Foreign Application Priority Data

Oct. 31, 2013 (CN) ..... 2013 1 0532741

(51) Int. Cl.
*G09G 3/32* (2016.01)

(52) U.S. Cl.
CPC ..... *G09G 3/3258* (2013.01); *G09G 3/3233* (2013.01); *G09G 2300/0814* (2013.01);
(Continued)

(58) Field of Classification Search
CPC combination set(s) only.
See application file for complete search history.

(56) References Cited

U.S. PATENT DOCUMENTS

2002/0180671 A1 12/2002 Inukai
2010/0164847 A1 7/2010 Lee et al.

FOREIGN PATENT DOCUMENTS

CN 103531150 A 6/2009
CN 103000131 A 3/2013
(Continued)

OTHER PUBLICATIONS

International Search Report Appln. No. PCT/CN2014/083351; Dated Oct. 27, 2014.
(Continued)

*Primary Examiner* — Van Chow
(74) *Attorney, Agent, or Firm* — Ladas & Parry LLP

(57) ABSTRACT

A pixel circuit for AC driving, a driving method and a display apparatus are capable of removing effect of internal resistance of a power supply line on the current for light-emitting and effect of the threshold voltage of the driving transistor on the display nonuniformity of a panel while effectively avoiding rapid aging of OLED. The pixel circuit includes: a first capacitor, a second capacitor, a voltage input unit, a data signal input unit, a first light emitting unit, a second light emitting unit and a light emitting control unit.

19 Claims, 9 Drawing Sheets

(52) U.S. Cl.
CPC ..... *G09G 2300/0819* (2013.01); *G09G 2300/0861* (2013.01); *G09G 2310/0256* (2013.01); *G09G 2320/0233* (2013.01); *G09G 2320/043* (2013.01); *G09G 2320/045* (2013.01)

(56) References Cited

FOREIGN PATENT DOCUMENTS

| | | | |
|---|---|---|---|
| CN | 103325340 | A | 9/2013 |
| CN | 103366682 | A | 10/2013 |
| KR | 20100077649 | A | 7/2010 |

OTHER PUBLICATIONS

Written Opinion of the International Searching Authority Appln. No. PCT/CN2014/083351; Dated Oct. 27, 2014.
International Search Report & Written Opinion Appln. No. PCT/CN2014/083351; Dated Oct. 27, 2015.

PIXEL CIRCUIT FOR AC DRIVING, DRIVING METHOD AND DISPLAY APPARATUS

TECHNICAL FIELD OF THE DISCLOSURE

The present disclosure relates to a pixel circuit for AC driving, a driving method and a display apparatus.

BACKGROUND

An AMOLED (Active Matrix Organic Light-Emitting Diode) is able to emit light as it is driven by a driving current generated by a driving TFT (Thin Film Transistor) in saturation. Different driving TFTs may have different critical voltages (i.e., threshold voltages) and may generate different driving currents when a same gray level voltage is input, thus rendering nonuniformity of the driving currents of the respective driving TFTs in the AMOLED. Under LTPS (Low Temperature Poly-silicon) manufacturing process, the threshold voltages Vth of TFTs have a poor uniformity and may have drifts as well, such that uniformity in luminance of AMOLED adopting the conventional 2T1C circuit is always poor. Another factor which has an effect on the uniformity in luminance of the AMOLED lies in that a power supply line which supplies power to OLED (Organic Light-Emitting Diode) has an internal resistance and OLED is a light emitting device driven by a current, a voltage drop is generated on the internal resistance of the power supply line when there is a current flowing through the OLED, thus directly rendering that power supply voltages at different locations cannot reach the required voltage.

In addition, aging problem of OLED is a common problem that all of the OLED light-emitting displays have to be faced with. DC driving is mostly adopted in the prior art, wherein the transmission directions of holes and electrons are fixed, the holes and electrons are injected to a light-emitting layer from a positive electrode and a negative electrode, respectively, and then excitons are formed in the light-emitting layer to radiate luminescent. Redundant holes (or electrons) which are not combined are accumulated at an interface between a hole transmission layer and the light-emitting layer (or an interface between the light-emitting layer and an electron transmission layer), or flow to the corresponding electrode across potential barrier. With prolong of the operation time, carriers not combined but accumulated at internal interfaces of the light-emitting layer allow that an built-in electric field is formed inside the OLED, which renders that the threshold voltage of the OLED increases continuously, the luminance of the OLED decreases continuously, and the energy utilization efficiency of the OLED decreases continuously. An AC driving circuit of OLED has been proposed in the prior art, which achieves AC driving for the OLED and solves the aging problem of the OLED, but cannot remove the effect of the internal resistance of the power supply line and the threshold voltage of the driving transistor on the display nonuniformity of the AMOLED.

SUMMARY

In order to solve the above technical problem, in embodiments of the present disclosure, there are provided a pixel circuit for AC driving, a driving method and a display apparatus capable of reducing the effect of the internal resistance of the power supply line and the threshold voltage of the driving transistor on the display nonuniformity of the AMOLED while effectively avoiding the rapid aging of the OLED.

In accordance with one aspect of the present disclosure, there is provided a pixel circuit for AC driving comprising: a first capacitor, a second capacitor, a voltage input unit, a data signal input unit, a first light emitting unit, a second light emitting unit and a light emitting control unit.

The first light emitting unit is configured to emit light under the control of a driving control terminal, a first light emitting control terminal, a first voltage input terminal and a second voltage input terminal; the second light emitting unit is configured to emit light under the control of the driving control terminal, a second light emitting control terminal, the first voltage input terminal and the second voltage input terminal; wherein the first light emitting unit emits light during a preset first time period and the second light emitting unit emits light during a preset second time period, and the first voltage input terminal is configured to supply a first input voltage at a first voltage terminal to the first light emitting unit and the second light emitting unit.

The voltage input unit is configured to supply a second input voltage at a second voltage terminal to the first light emitting unit and the second light emitting unit under the control of a first scan terminal. The data signal input unit is configured to input a data line signal of a data line to the second capacitor under the control of a second scan terminal. The light emitting control unit is configured to control the first light emitting unit or the second light emitting unit to emit light by aid of the driving control terminal, the first light emitting control terminal and the second light emitting control terminal under the control of a third scan terminal.

A first electrode of the first capacitor is connected to the first voltage terminal and a second electrode of the first capacitor is connected to the driving control terminal; and a first electrode of the second capacitor is connected to the data signal input unit and a second electrode of the second capacitor is connected to the driving control terminal.

Optionally, the light emitting control unit comprises a first switching transistor having a gate connected to the third scan terminal, a source connected to the driving control terminal, and a drain connected to the first light emitting control terminal and the second light emitting control terminal.

Optionally, the voltage input unit comprises a second switching transistor having a gate connected to the first scan terminal, a source connected to the second voltage terminal, and a drain connected to the second voltage input terminal.

Optionally, the data signal input unit comprises a third switching transistor having a gate connected to the second scan terminal, a source connected to the data line, and a drain connected to the first electrode of the second capacitor.

Optionally, the light emitting control unit comprises a first switching transistor and a fourth switching transistor; the first switching transistor has a gate connected to the third scan terminal, a source connected to the driving control terminal and a drain connected to the first light emitting control terminal; and the fourth switching transistor has a gate connected to the third scan terminal, a source connected to the driving control terminal and a drain connected to the second light emitting control terminal.

Optionally, the first light emitting unit comprises a first driving transistor and a first light emitting diode; the first driving transistor has a gate connected to the driving control terminal, a source connected to the first voltage input terminal and a drain connected to the first light emitting control terminal; and the first light emitting diode has a first electrode connected to the first light emitting control terminal and a second electrode connected to the second voltage input terminal. The second light emitting unit comprises a second driving transistor and a second light emitting diode; the second driving transistor has a gate connected to the driving control terminal, a source connected to the first voltage input terminal and a drain connected to the second light emitting control terminal; and the second light emitting diode has a first electrode connected to the second voltage input terminal and a second electrode connected to the second light emitting control terminal. The first driving transistor and the second driving transistor are of different types.

Optionally, the first light emitting unit emits light during a preset high level period or a preset low level period supplied between the first voltage terminal and the second voltage terminal, and the second light emitting unit emits light during a preset low level period or a preset high level period supplied between the first voltage terminal and the second voltage terminal.

Optionally, the first electrode of the first light emitting diode is an anode and the second electrode of the first light emitting diode is a cathode, and the first electrode of the second light emitting diode is an anode and the second electrode of the second light emitting diode is a cathode; the first light emitting unit emits light during a preset high level period supplied between the first voltage terminal and the second voltage terminal, and the second light emitting unit emits light during a preset low level period supplied between the first voltage terminal and the second voltage terminal.

Optionally, the first electrode of the first light emitting diode is a cathode and the second electrode of the first light emitting diode is an anode, and the first electrode of the second light emitting diode is a cathode and the second electrode of the second light emitting diode is an anode; the first light emitting unit emits light during a preset low level period supplied between the first voltage terminal and the second voltage terminal, and the second light emitting unit emits light during a preset high level period supplied between the first voltage terminal and the second voltage terminal.

In accordance with another aspect of the present disclosure, there is provided a display apparatus comprising the above described pixel circuit.

In accordance with another aspect of the present disclosure, there is provided a driving method for the above described pixel circuit comprising: during a first stage, controlling the voltage input unit to operate by aid of the first scan terminal, controlling the data signal input unit to operate by aid of the second scan terminal and controlling the light emitting control unit to operate by aid of the third scan terminal such that voltage at the driving control terminal is reset; during a second stage, controlling the voltage input unit to close by aid of the first scan terminal, controlling the data signal input unit to operate by aid of the second scan terminal and controlling the light emitting control unit to operate by aid of the third scan terminal such that the first capacitor is charged by the first voltage terminal and the second capacitor is charged by the data line; during a third stage, controlling the voltage input unit to close by aid of the first scan terminal, controlling the data signal input unit to operate by aid of the second scan terminal and controlling the light emitting control unit to close by aid of the third scan terminal such that a voltage transition is generated at the driving control terminal by a voltage transition at the data line due to the coupling effect of the second capacitor; during a fourth stage, controlling the voltage input unit to operate by aid of the first scan terminal, controlling the data signal input unit to close by aid of the second scan terminal and controlling the light emitting control unit to close by aid of the third scan terminal such that the first light emitting unit is driven to emit light by aid of the driving control terminal, the first light emitting control terminal, the first voltage input terminal and the second voltage input terminal; during a fifth stage, controlling the voltage input unit to operate by aid of the first scan terminal, controlling the data signal input unit to operate by aid of the second scan terminal and controlling the light emitting control unit to operate by aid of the third scan terminal such that the voltage at the driving control terminal is reset; during a sixth stage, controlling the voltage input unit to close by aid of the first scan terminal, controlling the data signal input unit to operate by aid of the second scan terminal and controlling the light emitting control unit to operate by aid of the third scan terminal such that the first capacitor is charged by the first voltage terminal and the second capacitor is charged by the data line; during a seventh stage, controlling the voltage input unit to close by aid of the first scan terminal, controlling the data signal input unit to operate by aid of the second scan terminal and controlling the light emitting control unit to close by aid of the third scan terminal such that a voltage transition is generated at the driving control terminal by a voltage transition at the data line due to the coupling effect of the second capacitor; and during an eighth stage, controlling the voltage input unit to operate by aid of the first scan terminal, controlling the data signal input unit to close by aid of the second scan terminal and controlling the light emitting control unit to close by aid of the third scan terminal such that the second light emitting unit is driven to emit light by aid of the driving control terminal, the second light emitting control terminal, the first voltage input terminal and the second voltage input terminal.

Optionally, in case that the light emitting control unit comprises the first switching transistor as described above, during the first stage, the first switching transistor, the second switching transistor, the third switching transistor and the first driving transistor are turned on, and the second driving transistor is turned off; during the second stage, the first switching transistor, the third switching transistor and the first driving transistor are turned on, and the second switching transistor and the second driving transistor are turned off; during the third stage, the first switching transistor and the second switching transistor are turned off, the third switching transistor is turned on, and the first driving transistor and the second driving transistor are in an open-circuit state; during the fourth stage, the first switching transistor, the third switching transistor and the second driving transistor are turned off, and the second switching transistor and the first driving transistor are turned on; during the fifth stage, the first switching transistor, the second switching transistor, the third switching transistor and the second driving transistor are turned on, and the first driving transistor is turned off; during the sixth stage, the first switching transistor, the third switching transistor and the second driving transistor are turned on, and the second switching transistor and the first driving transistor are turned off; during the seventh stage, the first switching transistor and the second switching transistor are turned off, the third switching transistor is turned on, and the first driving transistor and the second driving transistor are in an open-circuit state; and during the eighth stage, the first switching transistor, the third switching transistor and the first driving transistor are turned off, and the second switching transistor and the second driving transistor are turned on.

Optionally, in case that the light emitting control unit comprises the first switching transistor and the fourth switching transistor as described above, the method further comprises: during the first stage, the fourth switching transistor is turned on; during the second stage, the fourth switching transistor is turned on; during the third stage, the fourth switching transistor is turned off; during the fourth stage, the fourth switching transistor is turned off; during the fifth stage, the fourth switching transistor is turned on; during the sixth stage, the fourth switching transistor is turned on; during the seventh stage, the fourth switching transistor is turned off; and during the eighth stage, the fourth switching transistor is turned off.

In the pixel circuit for AC driving, the driving method and the display apparatus proposed in the embodiments of the present disclosure, compensation capacitors and two light emitting units which operate during a positive half cycle and a negative half cycle of the alternating current respectively are arranged in the pixel circuit, such that the effect of the internal resistance of the power supply line and the threshold voltage of the driving transistor on the display nonuniformity of the AMOLED can be reduced while the rapid aging of the OLED can be effectively avoided.

BRIEF DESCRIPTION OF THE DRAWINGS

In order to more clearly describe the technical solutions of the embodiments of the present disclosure or the prior art, drawings necessary for describing the embodiments of the present disclosure or the prior art are simply introduced as follows. It should be obvious for those skilled in the art that the drawings described as follows are only some embodiments of the present disclosure.

FIG. 8(*b*) is an equivalent circuit diagram of the pixel circuit for AC driving operating in a fourth stage provided in the embodiment of the present disclosure corresponding to FIG. 3;

FIG. 12(*b*) is an equivalent circuit diagram of the pixel circuit for AC driving operating in an eighth stage provided in the embodiment of the present disclosure corresponding to FIG. 3.

DETAILED DESCRIPTION

Hereinafter, the technical solutions in the embodiments of the present disclosure will be described clearly and thoroughly with reference to the accompanying drawings of the embodiments of the present disclosure. Obviously, the embodiments as described are only some of the embodiments of the present disclosure, and are not all of the embodiments of the present disclosure.

Switching transistors and driving transistors adopted in the embodiments of the present disclosure may be Thin Film Transistors or Field Effect Transistors or other devices having the same characteristics. In addition, the transistors adopted in the embodiments of the present disclosure may comprise P type transistors and N type transistors, wherein each of the P type transistors is turned on when its gate is at a low level and turned off when its gate is at a high level, and each of the N type transistors is turned on when its gate is at a high level and turned off when its gate is at a low level.

Figure 1:
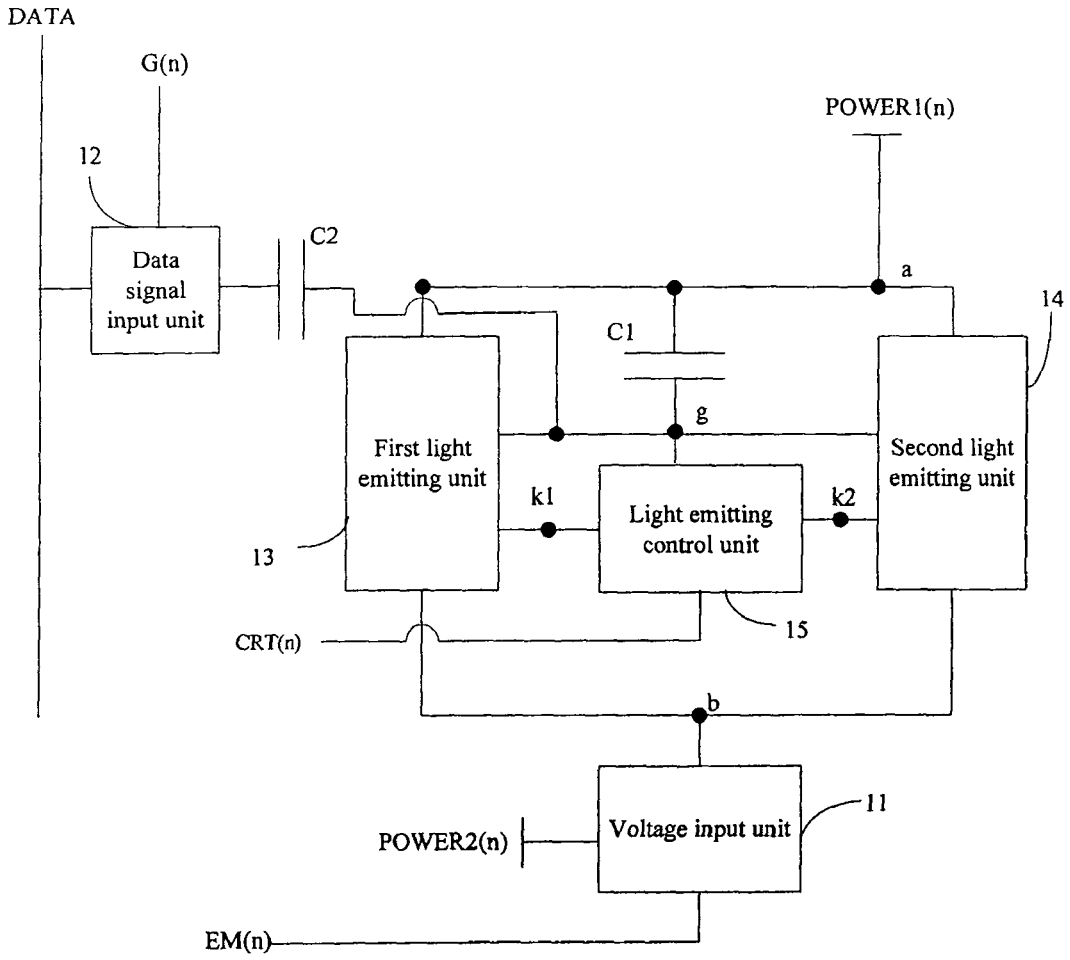
FIG. 1 is a schematic structure diagram of a pixel circuit for AC driving provided in embodiments of the present disclosure.

With reference to FIG. 1, a pixel circuit for AC driving in accordance with embodiments of the present disclosure comprises: a first capacitor C1, a second capacitor C2, a voltage input unit 11, a data signal input unit 12, a first light emitting unit 13, a second light emitting unit 14 and a light emitting control unit 15.

The first light emitting unit 13 is connected to a first voltage input terminal a, a second voltage input terminal b, a driving control terminal g and a first light emitting control terminal k1, and is configured to emit light under the control of the driving control terminal g, the first light emitting control terminal k1, the first voltage input terminal a and the second voltage input terminal b.

The second light emitting unit 14 is connected to the first voltage input terminal a, the second voltage input terminal b, the driving control terminal g and a second light emitting control terminal k2, and is configured to emit light under the control of the driving control terminal g, the second light emitting control terminal k2, the first voltage input terminal a and the second voltage input terminal b.

The first light emitting unit 13 emits light during a preset first time period and the second light emitting unit 14 emits light during a preset second time period.

The first voltage input terminal a is configured to supply a first input voltage at a first voltage terminal POWER1(*n*) to the first light emitting unit 13 and the second light emitting unit 14.

The voltage input unit 11 is connected to a second voltage terminal POWER2(*n*), the second voltage input terminal b and a first scan terminal EM(n); and is configured to supply a second input voltage at the second voltage terminal POWER2(*n*) to the first light emitting unit 13 and the second light emitting unit 14 under the control of the first scan terminal EM(n).

The data signal input unit 12 is connected to a data line DATA and a second scan terminal G(n), and is configured to input a data line signal of the data line DATA to the second capacitor C2 under the control of the second scan terminal G(n).

The light emitting control unit 15 is connected to the driving control terminal g, the first light emitting control terminal k1, the second light emitting control terminal k2 and a third scan terminal CRT(n), and is configured to control the first light emitting unit 13 or the second light emitting unit 14 to emit light by aid of the driving control terminal g, the first light emitting control terminal k1 and the second light emitting control terminal k2 under the control of the third scan terminal CRT(n).

A first electrode of the first capacitor C1 is connected to the first voltage terminal POWER1(*n*) and a second electrode of the first capacitor C1 is connected to the driving control terminal g.

A first electrode of the second capacitor C2 is connected to the data signal input unit 12 and a second electrode of the second capacitor C2 is connected to the driving control terminal g.

The first time period and the second time period can be two adjacent data frames but not limited thereto. The first time period and the second time period can be set according to requirement. Commonly, "a data frame (simply referred to as a frame)" is the time of "a display period" and is about several to tens milliseconds.

In the pixel circuit for AC driving provided in the embodiments of the present disclosure, the AC driving of the pixel circuit can be achieved by arranging compensation capacitors and two light emitting units which operate during different time periods respectively in the pixel circuit, thus removing the effect of the internal resistance of the power supply line on the current for light-emitting and the effect of the threshold voltage of the driving transistor on the display nonuniformity of the AMOLED while effectively avoiding the rapid aging of the OLED.

In accordance with the embodiments of the present disclosure, the light emitting control unit 15 may comprise a first switching transistor T1 having a gate connected to the third scan terminal CRT(n), a source connected to the driving control terminal g, and a drain connected to the first light emitting control terminal k1 and the second light emitting control terminal k2.

In accordance with the embodiments of the present disclosure, the voltage input unit 11 may comprise a second switching transistor T2 having a gate connected to the first scan terminal EM(n), a source connected to the second voltage terminal POWER2(*n*), and a drain connected to the second voltage input terminal b.

In accordance with the embodiments of the present disclosure, the data signal input unit 12 may comprise a third switching transistor T3 having a gate connected to the second scan terminal G(n), a source connected to the data line DATA, and a drain connected to the first electrode of the second capacitor C2.

In accordance with the embodiments of the present disclosure, the first light emitting unit 13 may comprise a first driving transistor DTFT1 and a first light emitting diode OLED1. The first driving transistor DTFT1 has a gate connected to the driving control terminal g, a source connected to the first voltage input terminal a and a drain connected to the first light emitting control terminal k1. The first light emitting diode OLED1 has a first electrode connected to the first light emitting control terminal k1 and a second electrode connected to the second voltage input terminal b.

The second light emitting unit 14 may comprise a second driving transistor DTFT2 and a second light emitting diode OLED2. The second driving transistor DTFT2 has a gate connected to the driving control terminal g, a source connected to the first voltage input terminal a and a drain connected to the second light emitting control terminal k2. The second light emitting diode OLED2 has a first electrode connected to the second voltage input terminal b and a second electrode connected to the second light emitting control terminal k2.

The first driving transistor DTFT1 and the second driving transistor DTFT2 are of different types. For example, the first driving transistor DTFT1 is a P type transistor and the second driving transistor DTFT2 is a N type transistor.

The first light emitting unit emits light during a preset high level period or a preset low level period supplied between the first voltage terminal POWER1(*n*) and the second voltage terminal POWER2(*n*), and the second light emitting unit emits light during a preset low level period or a preset high level period supplied between the first voltage terminal POWER1(*n*) and the second voltage terminal POWER2(*n*).

Optionally, when alternating current is supplied, the first light emitting unit emits light during a positive half cycle or a negative half cycle of the alternating current supplied between the first voltage terminal POWER1(*n*) and the second voltage terminal POWER2(*n*), and the second light emitting unit emits light during a negative half cycle or a positive half cycle of the alternating current supplied between the first voltage terminal POWER1(*n*) and the second voltage terminal POWER2(*n*). That is, the first light emitting unit emits light during a positive half cycle of the alternating current when the second light emitting unit emits light during a negative half cycle of the alternating current. Alternatively, the first light emitting unit emits light during a negative half cycle of the alternating current when the second light emitting unit emits light during a positive half cycle of the alternating current. Particularly, the alternating current can be supplied in the following manner: the voltage between the first voltage terminal POWER1(*n*) and the second voltage terminal POWER2(*n*) transits to its reverse voltage, when the current pixel circuit changes its output from the current frame to a next frame.

For example, during the first time period (for example, the current frame), the first light emitting diode OLED1 in the first light emitting unit 13 emits light, and the second light emitting diode OLED2 in the second light emitting unit 14 is reverse biased and is in a recovery phase; during the second time period (for example, the next frame), the first light emitting diode OLED1 in the first light emitting unit 13 is reverse biased and is in a recovery phase, and the second light emitting diode OLED2 in the second light emitting unit 14 emits light.

Figure 2:
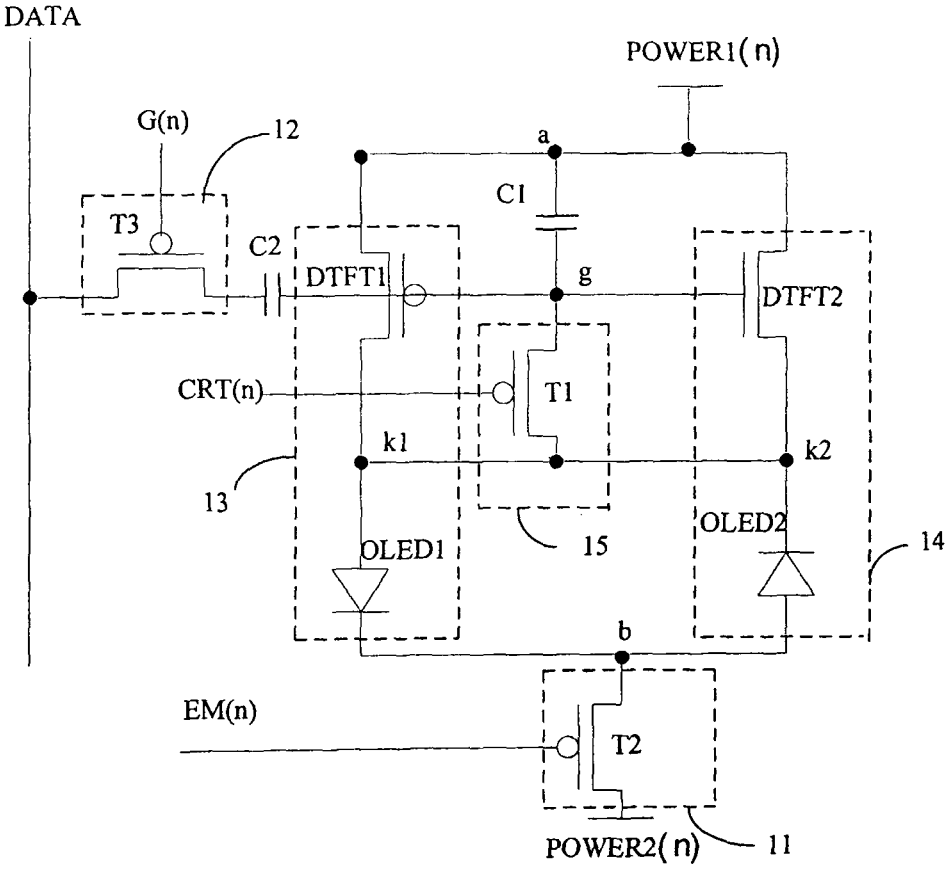
FIG. 2 is another schematic structure diagram of a pixel circuit for AC driving provided in the embodiments of the present disclosure.
Figure 3:
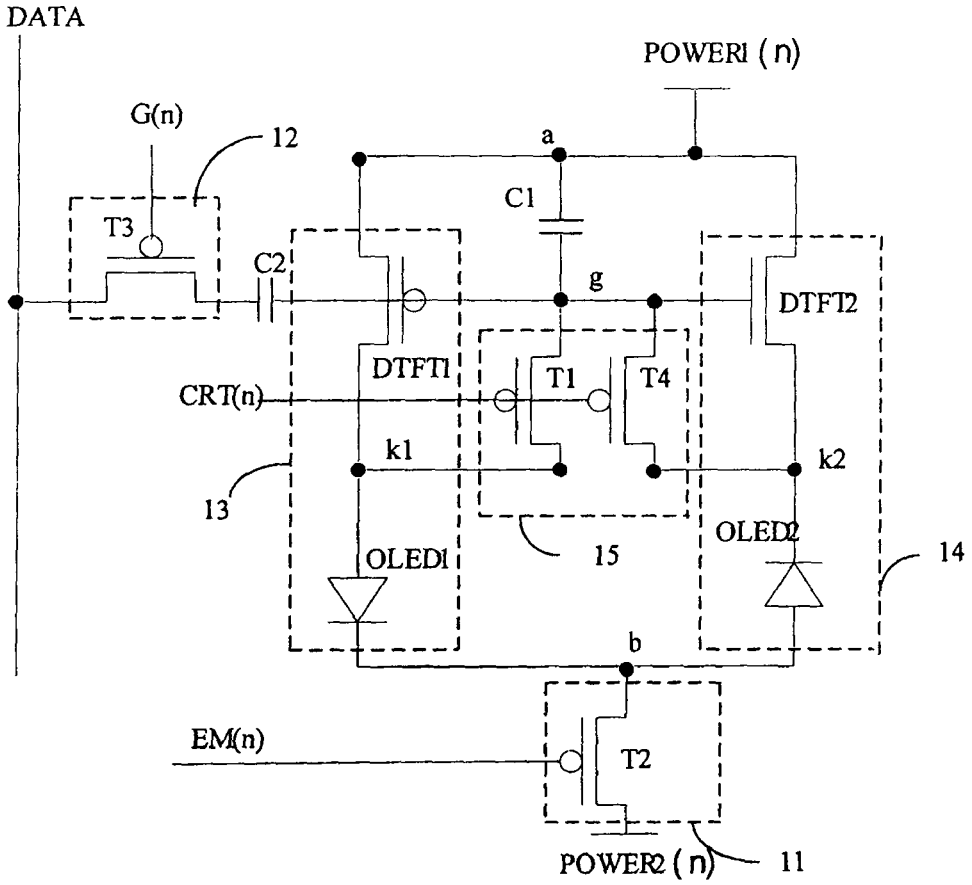
FIG. 3 is another schematic structure diagram of a pixel circuit for AC driving provided in the embodiments of the present disclosure.

Optionally, with reference to FIG. 3, different from FIG. 2, the light emitting control unit 15 comprises a first switching transistor T1 and a fourth switching transistor T4, the first switching transistor T1 has a gate connected to the third scan terminal CRT(n), a source connected to the driving control terminal g and a drain connected to the first light emitting control terminal k1; and the fourth switching transistor T4 has a gate connected to the third scan terminal CRT(n), a source connected to the driving control terminal g and a drain connected to the second light emitting control terminal k2.

In accordance with the embodiments of the present disclosure, there is provided a display apparatus comprising the above described pixel circuit.

In the display apparatus provided in the embodiments of the present disclosure, the AC driving of the pixel circuit can be achieved by arranging compensation capacitors and two light emitting units which operate during different time periods respectively in the pixel circuit, thus reducing the effect of the internal resistance of the power supply line and the threshold voltage of the driving transistor on the display nonuniformity of the AMOLED while effectively avoiding the rapid aging of the OLED.

In accordance with the embodiments of the present disclosure, there is further provided a driving method of pixel circuit which comprises eight stages.

During a first stage, the voltage input unit is controlled to operate by aid of the first scan terminal, the data signal input unit is controlled to operate by aid of the second scan terminal, and the light emitting control unit is controlled to operate by aid of the third scan terminal, such that voltage at the driving control terminal is reset.

During a second stage, the voltage input unit is controlled to close by aid of the first scan terminal, the data signal input unit is controlled to operate by aid of the second scan terminal, and the light emitting control unit is controlled to operate by aid of the third scan terminal, such that the first capacitor is charged by the first voltage terminal and the second capacitor is charged by the data line.

During a third stage, the voltage input unit is controlled to close by aid of the first scan terminal, the data signal input unit is controlled to operate by aid of the second scan terminal, and the light emitting control unit is controlled to close by aid of the third scan terminal, such that a voltage transition is generated at the driving control terminal by a voltage transition at the data line due to the coupling effect of the second capacitor.

During a fourth stage, the voltage input unit is controlled to operate by aid of the first scan terminal, the data signal input unit is controlled to close by aid of the second scan terminal, and the light emitting control unit is controlled to close by aid of the third scan terminal, such that the first light emitting unit is driven to emit light by aid of the driving control terminal, the first light emitting control terminal, the first voltage input terminal and the second voltage input terminal.

During a fifth stage, the voltage input unit is controlled to operate by aid of the first scan terminal, the data signal input unit is controlled to operate by aid of the second scan terminal, and the light emitting control unit is controlled to operate by aid of the third scan terminal, such that the voltage at the driving control terminal is reset.

During a sixth stage, the voltage input unit is controlled to close by aid of the first scan terminal, the data signal input unit is controlled to operate by aid of the second scan terminal, and the light emitting control unit is controlled to operate by aid of the third scan terminal, such that the first capacitor is charged by the first voltage terminal and the second capacitor is charged by the data line.

During a seventh stage, the voltage input unit is controlled to close by aid of the first scan terminal, the data signal input unit is controlled to operate by aid of the second scan terminal, and the light emitting control unit is controlled to close by aid of the third scan terminal, such that a voltage transition is generated at the driving control terminal by a voltage transition at the data line due to the coupling effect of the second capacitor.

During an eighth stage, the voltage input unit is controlled to operate by aid of the first scan terminal, the data signal input unit is controlled to close by aid of the second scan terminal, and the light emitting control unit is controlled to close by aid of the third scan terminal, such that the second light emitting unit is driven to emit light by aid of the driving control terminal, the second light emitting control terminal, the first voltage input terminal and the second voltage input terminal.

Optionally, the method further comprises the following operations. During the first stage, the first switching transistor, the second switching transistor, the third switching transistor and the first driving transistor are turned on, and the second driving transistor is turned off; during the second stage, the first switching transistor, the third switching transistor and the first driving transistor are turned on, and the second switching transistor and the second driving transistor are turned off; during the third stage, the first switching transistor and the second switching transistor are turned off, the third switching transistor is turned on, and the first driving transistor and the second driving transistor are in an open-circuit state; during the fourth stage, the first switching transistor, the third switching transistor and the second driving transistor are turned off, and the second switching transistor and the first driving transistor are turned on; during the fifth stage, the first switching transistor, the second switching transistor, the third switching transistor and the second driving transistor are turned on, and the first driving transistor is turned off; during the sixth stage, the first switching transistor, the third switching transistor and the second driving transistor are turned on, and the second switching transistor and the first driving transistor are turned off; during the seventh stage, the first switching transistor and the second switching transistor are turned off, the third switching transistor is turned on, and the first driving transistor and the second driving transistor are in an open-circuit state; and during the eighth stage, the first switching transistor, the third switching transistor and the first driving transistor are turned off, and the second switching transistor and the second driving transistor are turned on.

Furthermore, the method further comprises the following operations. During the first stage, the fourth switching transistor is turned on; during the second stage, the fourth switching transistor is turned on; during the third stage, the fourth switching transistor is turned off; during the fourth stage, the fourth switching transistor is turned off; during the fifth stage, the fourth switching transistor is turned on; during the sixth stage, the fourth switching transistor is turned on; during the seventh stage, the fourth switching transistor is turned off; and during the eighth stage, the fourth switching transistor is turned off.

In the driving method for the pixel circuit for AC driving provided in the embodiments of the present disclosure, the AC driving of the pixel circuit can be achieved by arranging compensation capacitors and two light emitting units which operate during different time periods respectively in the pixel circuit, thus removing the effect of the internal resistance of the power supply line on the current for light-emitting and the effect of the threshold voltage of the driving transistor on the display nonuniformity of the AMOLED while effectively avoiding the rapid aging of the OLED.

The above first scan terminal, the above second scan terminal and the above third scan terminal can be supplied power in a separate manner, or can be supplied power in a manner of scan lines, or can be supplied power in any combination manner of the above two manners. The following specific embodiments will be described in the manner of scan lines, that is, the first scan line functions as the first scan terminal, the second scan line functions as the second scan terminal, and the third scan line functions as the third scan terminal, so as to supply and input control signals to the circuit in accordance with the embodiments of the present disclosure.

Figure 4:
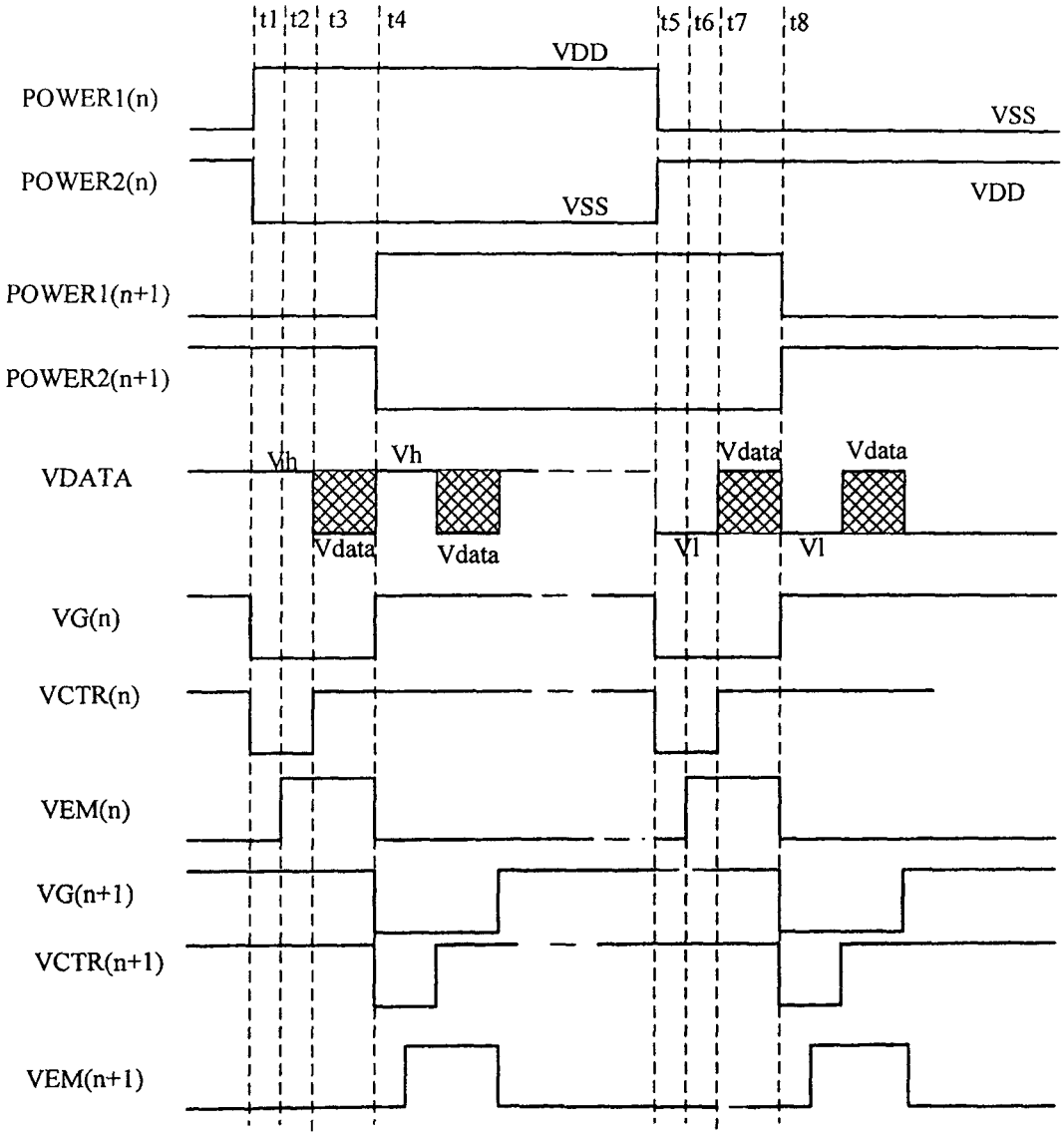
FIG. 4 is a schematic diagram of timing sequence states of input signals of the pixel circuit for AC driving provided in the embodiments of the present disclosure.

Particularly, the driving method for the pixel circuit provided in the embodiments of the present disclosure will be described in detail by combining the timing sequence state diagram as shown in FIG. 4 and the pixel circuit as shown in FIG. 2 or FIG. 3 and taking the case that the first time period and the second time period are two adjacent data frames ($N^{th}$ and $(N+1)^{th}$) as an example.

FIG. 3 is a principal diagram of a pixel driving circuit in accordance with the embodiments of the present disclosure. The structure of the circuit as a whole comprises four switching transistors (T1-T4), two driving transistors DTFT1 and DTFT2, two capacitors C1 and C2, and two light emitting diodes OLED1 and OLED2, wherein DTFT1 is of P type, DTFT2 is of N type, T1-T5 are all P type switching transistors. It should be understood that a light emitting diode comprises a cathode and an anode and thus a first electrode and a second electrode of each of the above light emitting diodes are a cathode and an anode of the light emitting diode, respectively, and are connected to the drain of the driving transistor according to specific requirement. In the present embodiment, the first electrode of the light emitting diode is the anode and the second electrode of the light emitting diode is the cathode. For each row, the pixel circuits in this row share a first scan signal EM(n) for controlling light-emitting, a second scan signal G(n), a third scan signal CRT(n), two power supply signals supplied from a first voltage terminal POWER1(*n*) and a second voltage terminal POWER2(*n*) respectively, and a data line DATA.

It should be noted that the pixel circuits in a same row should be controlled by individual power supply signals, and the power supply signals (the first voltage terminal POWER1 and the second voltage terminal POWER2) for the pixel circuits in the same row should flip over every frame time period.

With reference to FIG. 4, power supplies for the current pixel circuit are supplied from the first voltage terminal POWER1(*n*) and the second voltage terminal POWER2(*n*), and power supplies for the pixel circuit of a next stage are supplied from the first voltage terminal POWER1(*n*+1) and the second voltage terminal POWER2(*n*+1).

FIG. 4 further shows: the first scan line signal EM(n), the second scan line signal G(n) and the third scan line signal CRT(n) for the current pixel circuit; the first scan line signal EM(n+1), the second scan line signal G(n+1) and the third scan line signal CRT(n+1) for the pixel circuit of the next stage; and the data line signal VDATA. The operation of the pixel circuits in a same row is divided into four stages for each frame, as shown in FIG. 4, the operation of the pixel circuits in the same row comprises four stages t1-t4 for the current frame and four stages t5-t8 for the next frame. Since the light-emitting driving for two adjacent frames are performed alternately by symmetric portions in the pixel circuit, the operation of the circuit in each of total eight stages for the two adjacent frames will be described one by one, but the operation of the circuit itself only needs four stages.

The ON level of the N-type switching transistor is a high level VGH and the OFF level of the N-type switching transistor is a low level VGL. The ON level of the P-type switching transistor is a low level VGL and the OFF level of the P-type switching transistor is a high level VGL. A high level of the power supplies is VDD and a low level of the power supplies is VSS. Of course, the explanation is given by taking P-type switching transistors as an example. When N-type switching transistors are adopted, the timing sequence of the signal at the gate should be adjusted only if the switching transistors in the embodiments of the present disclosure can achieve the switching function in the method claims.

The specific timing sequence diagram of the circuit is as shown in FIG. 4 and the operation in the four stages of the $N^{th}$ frame is as follows.

Figure 5:
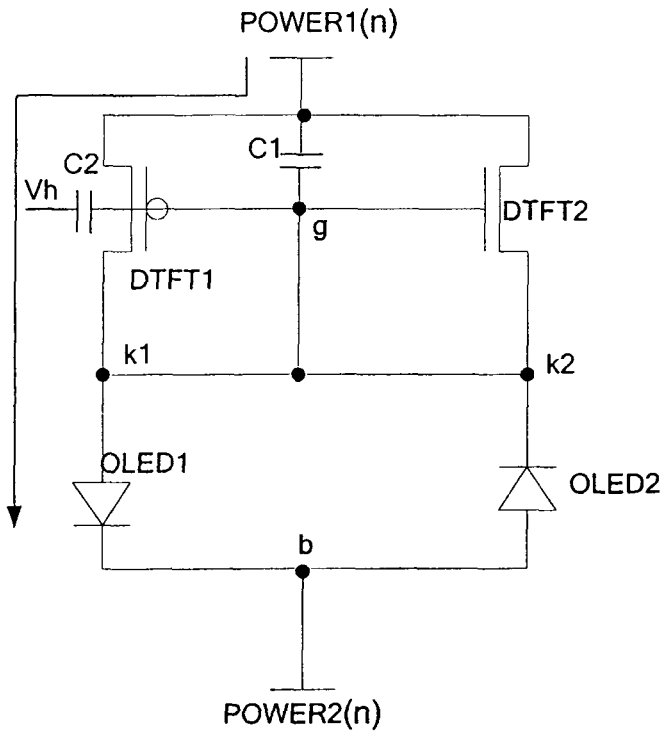
FIG. 5 is an equivalent circuit diagram of the pixel circuit for AC driving operating in a first stage provided in the embodiments of the present disclosure.

During a first stage t1, the equivalent circuit is as shown in FIG. 5, G(n), CRT(n) and EM(n) are all at a low level. T1, T2, T3 and T4 are turned on, meanwhile POWER2(*n*) transits from VDD to VSS and POWER1(*n*) transits from VSS to VDD. At this time, signal at the data line DATA is Vh, and it should be explained that, for DTFT1, Vh is equal to a maximum value of Vdata (here, the design value of Vh may be the power supply voltage VDD). DTFT1 is in a forward-biased state and DTFT2 is in a reverse-biased and turned-off state.

This stage functions to remove the signal voltage of a previous stage, such that the potential at the point g is reset and pulled down to VSS+Voled1, Voled1 is a voltage across the OLED1 for light-emitting, the OLED1 is forward biased and a current flows through the OLED1, and the OLED2 is in an open-circuit state due to the turned-off DTFT2.

Figure 6:
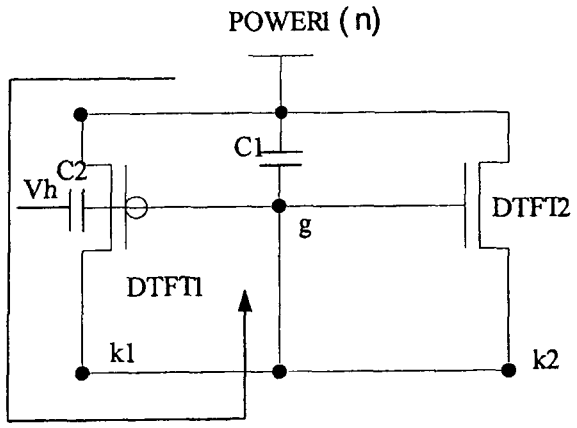
FIG. 6 is an equivalent circuit diagram of the pixel circuit for AC driving operating in a second stage provided in the embodiments of the present disclosure.

During a second stage t2, the equivalent circuit is as shown in FIG. 6, G(n) and CRT(n) keep to be at the low level, EM(n) transits to a high level, T1, T3 and T4 are turned on, and T2 is turned off. DTFT1 is forward biased and DTFT2 is in the reverse-biased and turned-off state. The voltage at the data line DATA maintains to be Vh, T2 is turned off since the DTFT1 is turned on, and the current continuously flows through the DTFT1 and arrives at the gate of the DTFT1 until the potential at the point g is increased to VDD-|Vthd1|, wherein Vthd1 is a threshold voltage of the DTFT1.

It should be explained that the power supplies VDD and VSS are both in an open-circuit state and thus there is no current flowing through the power supplies, and POWER1(*n*) is at the designed power supply potential value VDD, that is, the potential Va at the terminal a is not affected by the internal resistance of the power supply line.

Figure 7:
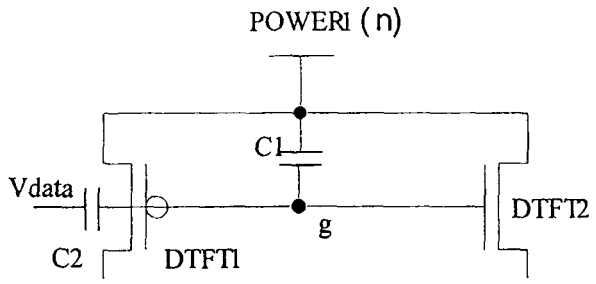
FIG. 7 is an equivalent circuit diagram of the pixel circuit for AC driving operating in a third stage provided in the embodiments of the present disclosure.

During a third stage t3, the equivalent circuit is as shown in FIG. 7, G(n) keeps to be at the low level, EM(n) keeps to be at the high level, and CRT(n) transits to a high level, such that T1, T2 and T4 are turned off, T3 is turned on, DTFT1 and DTFT2 are in an open-circuit state, and thus the voltage at the data line DATA transits to the signal voltage Vdata, and the potential at the point g also transits due to the coupling effect of C2 since the point g is floating when T1 and T4 are turned off. The potential at the point g transits to $$Vg=VDD-|Vthd1|+(V\text{data}-Vh)*C2/(C1+C2);$$

and thus the voltage across the two electrodes of C1 is:

$$Vc1=Va-Vg=VDD-Vg=(Vh-V\text{data})*C2/(C1+C2)+|Vthd1|.$$

At this time, since the power supplies VDD and VSS are both in an open-circuit state and there is no current flowing through the power supplies, POWER1(*n*) is at the designed power supply potential value VDD, that is, the voltage across the two electrodes of C1 is not affected by the internal resistance of the power supply line.

Figure 8A:
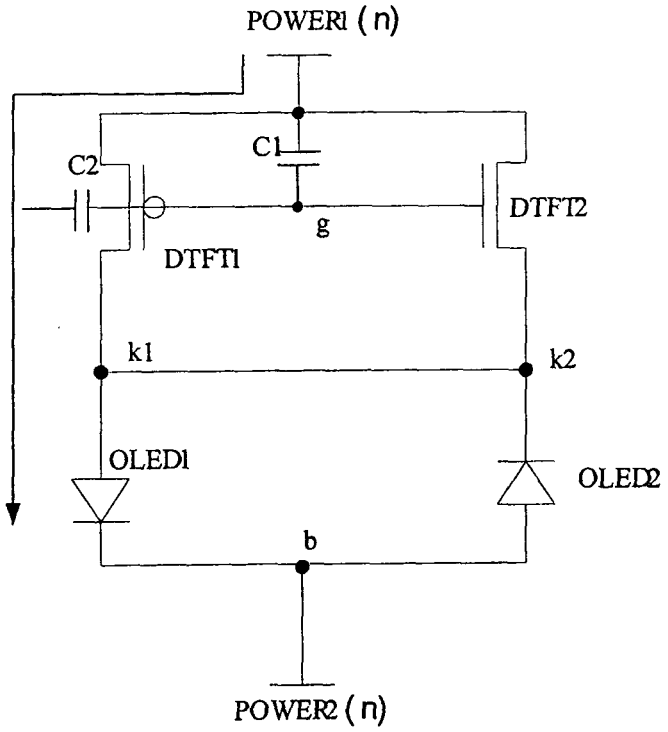
FIG. 8(*a*) is an equivalent circuit diagram of the pixel circuit for AC driving operating in a fourth stage provided in the embodiment of the present disclosure corresponding to FIG. 2.
Figure 8B:
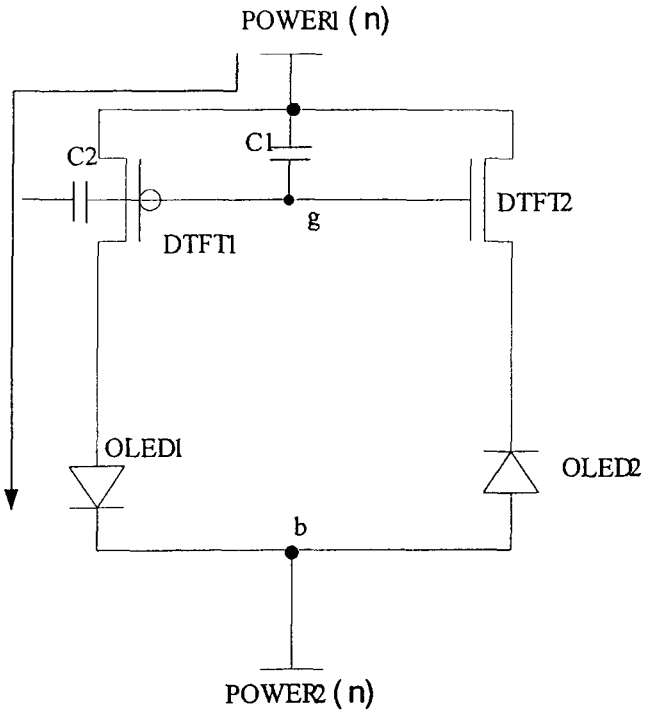

During a fourth stage t4, the equivalent circuit is as shown in FIG. 8(*a*) (corresponding to the pixel circuit shown in FIG. 2) and FIG. 8(*b*) (corresponding to the pixel circuit shown in FIG. 3). Since the pixel circuit shown in FIG. 2 and the pixel circuit shown in FIG. 3 have different configuration, their equivalent circuits are different from each other slightly but can achieve the same function. In this stage, G(n) transits to a high level, EM(n) transits to a low level, and CRT(n) keeps to be at the high level, such that T1, T3 and T4 are turned off and T2 is turned on. The point g is floating since T1, T3 and T4 are turned off. The gate-source voltage Vsg of the DTFT1 is the voltage across the two electrodes of the capacitor C1 and can be represented by: Vsg=Vc1=(Vh−Vdata)*C2/(C1+C2)+|Vthd1|.

The driving current flowing through the DTFT1 is the light-emitting current of the OLED1 and can be represented by:

$$\begin{aligned} Ioled1 &= kd1(Vsg - |Vthd1|)\hat{}2 \\ &= kd1[(Vh - Vdata) * C2/(C1 + C2) + |Vthd1| - |Vthd1|]\hat{}2 \\ &= kd1[(Vh - Vdata) * C2/(C1 + C2)]\hat{}2; \end{aligned}$$

Kd1 is a constant relating to the manufacturing process and the size configuration of the driving transistor DTFT1, and Vthd1 is the threshold voltage of the DTFT1. The driving current is only affected by the data voltage Vdata and the maximum value Vh of Vdata, but is not relevant to the threshold voltage of the driving transistor DTFT1.

OLED1 starts to be forward biased from this stage, enters into the positive half cycle of the AC driving from the negative half cycle of the AC driving, and enters into its operation phase. Meanwhile, OLED2 enters into a reverse-biased state from this stage, such that no current flows through the OLED2 and OLED2 does not emit light and enters into a recovery state, and DTFT2 is in an open-circuit state. OLED2 enters into the negative half cycle of the AC driving from the positive half cycle of the AC driving and will stay in the negative half cycle of the AC driving during the time period of a frame. During the negative half cycle of the AC driving, the remaining holes and electrons at the interfaces of the light emitting layer change their moving directions to move toward opposite directions, which is equivalent to consuming the remaining holes and electrons, thus diminishing the built-in electrical field formed inside OLED2 by the remaining carriers in the positive half cycle, further enhancing the carrier injection and recombination in the next positive half cycle, and finally improving the recombination efficiency. Moreover, the reverse bias process in the negative half cycle can "burn out" some microscopic small channels "filaments" turned on locally. Such a filament is actually caused by a kind of "pinhole", and the elimination of the pinholes is very important for extending the usage life of the device. Therefore, in other words, OLED2 is in a recovery period during the time period of this frame.

After the time period of one frame, the $n^{th}$ row enters into a $(N+1)^{th}$ frame, the operation of the circuit in the four stages for this frame is as follows.

Figure 9:
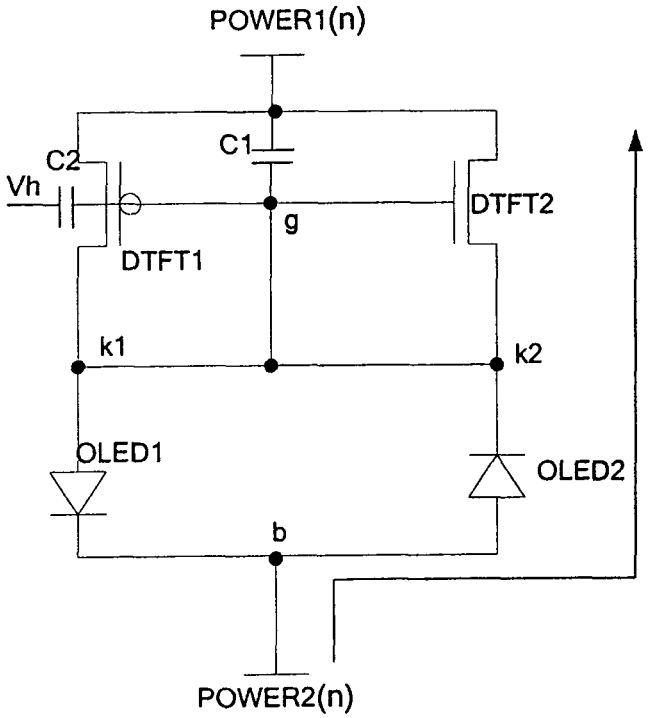
FIG. 9 is an equivalent circuit diagram of the pixel circuit for AC driving operating in a fifth stage provided in the embodiments of the present disclosure.

During a fifth stage t5, the equivalent circuit is as shown in FIG. 9, G(n), CRT(n) and EM(n) are all at a low level. T1, T2, T3 and T4 are turned on, meanwhile POWER1(*n*) transits from VDD to VSS and POWER2(*n*) transits from VSS to VDD.

At this time, signal at the data line DATA is V1, and it should be explained that, for DTFT2, V1 is equal to a minimum value of Vdata (here, the value may be designed as the minimum value VSS of the power supply voltage). DTFT2 is in a forward-biased state and DTFT1 is in a reverse-biased and turned-off state. This stage functions to remove the signal voltage of a previous stage, such that the potential at the point g is reset and pulled up to VDD-Voled2, Voled2 is a voltage across the OLED2 for light-emitting, the OLED2 is forward biased and a current flows through the OLED2, and the OLED1 is in an open-circuit state due to the turned-off DTFT1.

Figure 10:
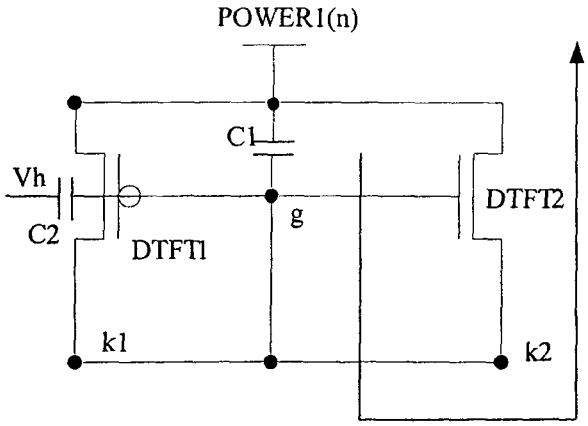
FIG. 10 is an equivalent circuit diagram of the pixel circuit for AC driving operating in a sixth stage provided in the embodiments of the present disclosure.

During a sixth stage t6, the equivalent circuit is as shown in FIG. 10, G(n) and CRT(n) keep to be at the low level, EM(n) transits to a high level, T1, T3 and T4 are turned on, and T2 is turned off. DTFT2 is forward biased and DTFT1 is in the reverse-biased and turned-off state. The voltage at the data line DATA maintains to be V1, T2 is turned off since the DTFT2 is turned on, and the capacitor C1 is discharged through the DTFT2 until the potential at the point g is decreased to VSS+Vthd2, wherein Vthd2 is a threshold voltage of the DTFT2. It should be explained that the power supplies VDD and VSS are both in an open-circuit state and thus there is no current flowing through the power supplies, and POWER1(*n*) is at the designed power supply potential value VSS, that is, the potential Va at the terminal a is not affected by the internal resistance of the power supply line.

Figure 11:
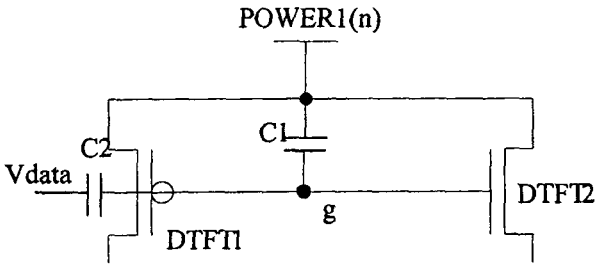
FIG. 11 is an equivalent circuit diagram of the pixel circuit for AC driving operating in a seventh stage provided in the embodiments of the present disclosure.

During a seventh stage t7, the equivalent circuit is as shown in FIG. 11, G(n) keeps to be at the low level, EM(n) keeps to be at the high level, and CRT(n) transits to a high level, such that T1, T2 and T4 are turned off, T3 is turned on, DTFT1 and DTFT2 are both in an open-circuit state, and thus the voltage at the data line DATA transits to the signal voltage Vdata, and the potential at the point g also transits due to the coupling effect of C2 since the point g is floating when T1 and T4 are turned off. The potential at the point g transits to $$Vg=VSS+Vthd2+(V\text{data}-V1)*C2/(C1+C2);$$

and thus the voltage across the two electrodes of C1 is:

$$\begin{aligned} Vc1 &= Vg - Va \\ &= Vg - VSS \\ &= Vthd2 + (Vdata - Vl) * C2/(C1 + C2). \end{aligned}$$

At this time, since the power supplies VDD and VSS are both in an open-circuit state and there is no current flowing through the power supplies, POWER1(*n*) is at the designed power supply potential value VSS, that is, the voltage across the two electrodes of C1 is not affected by the internal resistance of the power supply line.

Figure 12A:
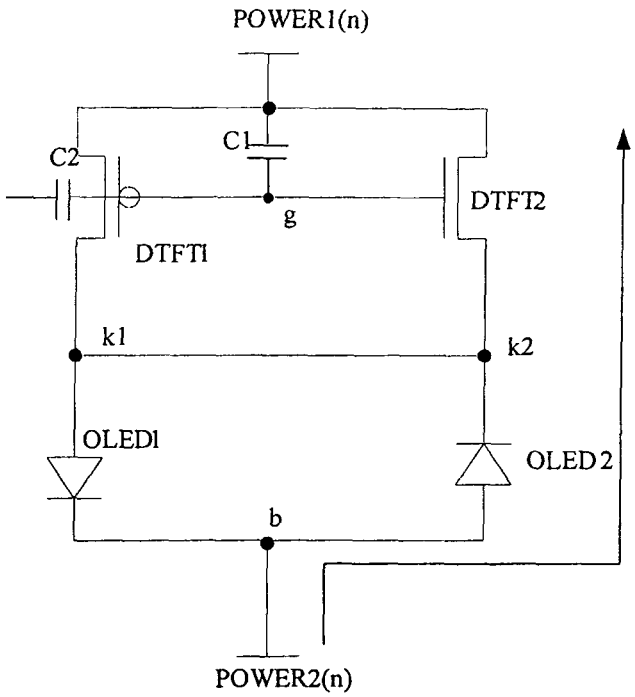
FIG. 12(*a*) is an equivalent circuit diagram of the pixel circuit for AC driving operating in an eighth stage provided in the embodiment of the present disclosure corresponding to FIG. 2.
Figure 12B:
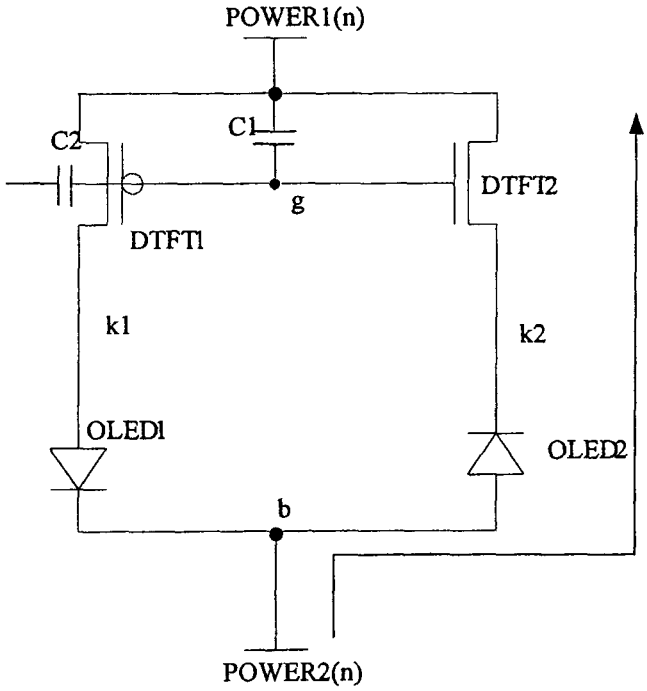

During an eighth stage t8, the equivalent circuit is as shown in FIG. 12(*a*) (corresponding to the pixel circuit shown in FIG. 2) and FIG. 12(*b*) (corresponding to the pixel circuit shown in FIG. 3). Since the pixel circuit shown in FIG. 2 and the pixel circuit shown in FIG. 3 have different configuration, their equivalent circuits are different from each other slightly but can achieve the same function. In this stage, G(n) transits to a high level, EM(n) transits to a low level, and CRT(n) keeps to be at the high level, such that T1, T3 and T4 are turned off and T2 is turned on. The point g is floating since T1, T3 and T4 are turned off. The gate-source voltage of the DTFT2 is the voltage across the two electrodes of the capacitor C1 and can be represented by: Vgs=Vc1=Vthd2+(Vdata−V1)*C2/(C1+C2).

The driving current flowing through the DTFT2 is the light-emitting current of the OLED2 and can be represented by:

$$\begin{aligned} Ioled2 &= kd2(Vgs - Vthd2)\hat{}2 \\ &= kd2[Vthd2 + (Vdata - Vl) * C2/(C1 + C2) - Vthd2]\hat{}2 \\ &= kd2[(Vdata - Vl) * C2/(C1 + C2)]\hat{}2; \end{aligned}$$

Kd2 is a constant relating to the manufacturing process and the size configuration of the driving transistor DTFT2, and Vthd2 is the threshold voltage of the DTFT2. The driving current is only affected by the data voltage Vdata and the minimum value V1 of Vdata, but is not relevant to the threshold voltage of the driving transistor DTFT2.

OLED2 starts to be forward biased from this stage, enters into the positive half cycle of the AC driving from the negative half cycle of the AC driving, and enters into its operation phase. Meanwhile, OLED1 enters into a reverse-biased state from this stage, such that no current flows through the OLED1 and OLED1 does not emit light and enters into a recovery state. Same as the function of the circuit on OLED2 in the fourth stage, this stage can extend the usage life of OLED1.

The operation of the driving circuit during two adjacent frames according to the embodiments of the present disclosure has been described above. It should be explained that the data line should supply different data line voltages for different driving transistors since the driving transistors are different and the expressions of the driving current are also different during the two adjacent frames. Particularly, with reference to the timing sequence state diagram as shown in FIG. 4, during the time period of the $N^{th}$ frame, the data line supplies VDD during the first stage and the second stage and supplies the data signal Vdata during the third stage, and the signal supplied at the data line has no function on the pixel circuits in the row during the fourth stage since the data signal input unit 12 is closed; during the time period of the $N+1^{th}$ frame, the data line supplies VSS during the fifth stage and the sixth stage and supplies the data signal Vdata during the seventh stage, and the signal supplied at the data line has no function on the pixel circuits in the row during the eighth stage since the data signal input unit 12 is closed.

Of course, optionally, with reference to FIG. 2, the corresponding function can also be achieved when 3 switching transistors are adopted in the embodiments of the present disclosure, and the operation principle is the same and repeated description is omitted herein. Of course, the switching transistors in the pixel circuit can adopt the thin film transistors produced under the process of amorphous silicon, polysilicon, oxide and so one, and the pixel circuit can be easily modified into other NMOS, PMOS or CMOS circuit after simplification, replacement or combination only if the timing sequence relationship of the input signals is adjusted correspondingly. Therefore, any variation or modification falls in the scope of the embodiments of the present disclosure only if it does not depart from the essential nature of the embodiments of the present disclosure.

The above descriptions are only for illustrating the embodiments of the present disclosure, and in no way limit the scope of the present disclosure. It will be obvious that those skilled in the art may make variations or alternatives to the above embodiments without departing from the spirit and scope of the present disclosure as defined by the following claims. Such variations and alternatives are intended to be included within the spirit and scope of the present disclosure. Therefore, the protection scope of the present disclosure should be defined by the protection scope of the accompanying claims.

The present application claims the priority of a Chinese application entitled "pixel circuit for AC driving, driving method and display apparatus" with an application number No. 201310532741.X and filed on Oct. 31, 2013, the disclosure of which is entirely incorporated herein by reference.

What is claimed is:

1. A pixel circuit for AC driving comprising: a first capacitor, a second capacitor, a voltage input unit, a data signal input unit, a first light emitting unit, a second light emitting unit and a light emitting control unit; wherein the first light emitting unit is configured to emit light under the control of a driving control terminal, a first light emitting control terminal, a first voltage input terminal and a second voltage input terminal;

the second light emitting unit is configured to emit light under the control of the driving control terminal, a second light emitting control terminal, the first voltage input terminal and the second voltage input terminal; wherein the first light emitting unit emits light during a preset first time period and the second light emitting unit emits light during a preset second time period, and the first voltage input terminal is configured to supply a first input voltage at a first voltage terminal to the first light emitting unit and the second light emitting unit;

the voltage input unit is configured to supply a second input voltage at a second voltage terminal to the first light emitting unit and the second light emitting unit under the control of a first scan terminal;

the data signal input unit is configured to input a data line signal of a data line to the second capacitor under the control of a second scan terminal;

the light emitting control unit is configured to control the first light emitting unit or the second light emitting unit to emit light by aid of the driving control terminal, the first light emitting control terminal and the second light emitting control terminal under the control of a third scan terminal;

a first electrode of the first capacitor is connected to the first voltage terminal and a second electrode of the first capacitor is connected to the driving control terminal; and a first electrode of the second capacitor is connected to the data signal input unit and a second electrode of the second capacitor is connected to the driving control terminal.

2. The pixel circuit of claim 1, wherein the light emitting control unit comprises a first switching transistor having a gate connected to the third scan terminal, a source connected to the driving control terminal, and a drain connected to the first light emitting control terminal and the second light emitting control terminal.

3. The pixel circuit of claim 1, wherein the voltage input unit comprises a second switching transistor having a gate connected to the first scan terminal, a source connected to the second voltage terminal, and a drain connected to the second voltage input terminal.

4. The pixel circuit of claim 1, wherein the data signal input unit comprises a third switching transistor having a gate connected to the second scan terminal, a source connected to the data line, and a drain connected to the first electrode of the second capacitor.

5. The pixel circuit of claim 1, wherein the light emitting control unit comprises a first switching transistor and a fourth switching transistor;

the first switching transistor has a gate connected to the third scan terminal, a source connected to the driving control terminal and a drain connected to the first light emitting control terminal; and the fourth switching transistor has a gate connected to the third scan terminal, a source connected to the driving control terminal and a drain connected to the second light emitting control terminal.

6. The pixel circuit of claim 1, wherein the first light emitting unit comprises a first driving transistor and a first light emitting diode; wherein the first driving transistor has a gate connected to the driving control terminal, a source connected to the first voltage input terminal and a drain connected to the first light emitting control terminal; and the first light emitting diode has a first electrode connected to the first light emitting control terminal and a second electrode connected to the second voltage input terminal;

the second light emitting unit comprises a second driving transistor and a second light emitting diode; wherein the second driving transistor has a gate connected to the driving control terminal, a source connected to the first voltage input terminal and a drain connected to the second light emitting control terminal; and the second light emitting diode has a first electrode connected to the second voltage input terminal and a second electrode connected to the second light emitting control terminal;

the first driving transistor and the second driving transistor are of different types.

7. The pixel circuit of claim 6, wherein the first electrode of the first light emitting diode is an anode and the second electrode of the first light emitting diode is a cathode, and the first electrode of the second light emitting diode is an anode and the second electrode of the second light emitting diode is a cathode;

the first light emitting unit emits light during a preset high level period supplied between the first voltage terminal and the second voltage terminal, and the second light emitting unit emits light during a preset low level period supplied between the first voltage terminal and the second voltage terminal.

8. The pixel circuit of claim 6, wherein the first electrode of the first light emitting diode is a cathode and the second electrode of the first light emitting diode is an anode, and the first electrode of the second light emitting diode is a cathode and the second electrode of the second light emitting diode is an anode;

the first light emitting unit emits light during a preset low level period supplied between the first voltage terminal and the second voltage terminal, and the second light emitting unit emits light during a preset high level period supplied between the first voltage terminal and the second voltage terminal.

9. A display apparatus comprising a pixel circuit, wherein the pixel circuit comprises: a first capacitor, a second capacitor, a voltage input unit, a data signal input unit, a first light emitting unit, a second light emitting unit and a light emitting control unit; wherein the first light emitting unit is configured to emit light under the control of a driving control terminal, a first light emitting control terminal, a first voltage input terminal and a second voltage input terminal;

the second light emitting unit is configured to emit light under the control of the driving control terminal, a second light emitting control terminal, the first voltage input terminal and the second voltage input terminal; wherein the first light emitting unit emits light during a preset first time period and the second light emitting unit emits light during a preset second time period, and the first voltage input terminal is configured to supply a first input voltage at a first voltage terminal to the first light emitting unit and the second light emitting unit;

the voltage input unit is configured to supply a second input voltage at a second voltage terminal to the first light emitting unit and the second light emitting unit under the control of a first scan terminal;

the data signal input unit is configured to input a data line signal of a data line to the second capacitor under the control of a second scan terminal;

the light emitting control unit is configured to control the first light emitting unit or the second light emitting unit to emit light by aid of the driving control terminal, the first light emitting control terminal and the second light emitting control terminal under the control of a third scan terminal;

a first electrode of the first capacitor is connected to the first voltage terminal and a second electrode of the first capacitor is connected to the driving control terminal; and a first electrode of the second capacitor is connected to the data signal input unit and a second electrode of the second capacitor is connected to the driving control terminal.

10. The display apparatus of claim 9, wherein the light emitting control unit comprises a first switching transistor having a gate connected to the third scan terminal, a source connected to the driving control terminal, and a drain connected to the first light emitting control terminal and the second light emitting control terminal.

11. The display apparatus of claim 9, wherein the voltage input unit comprises a second switching transistor having a gate connected to the first scan terminal, a source connected to the second voltage terminal, and a drain connected to the second voltage input terminal.

12. The display apparatus of claim 9, wherein the data signal input unit comprises a third switching transistor having a gate connected to the second scan terminal, a source connected to the data line, and a drain connected to the first electrode of the second capacitor.

13. The display apparatus of claim 9, wherein the light emitting control unit comprises a first switching transistor and a fourth switching transistor;

the first switching transistor has a gate connected to the third scan terminal, a source connected to the driving control terminal and a drain connected to the first light emitting control terminal; and the fourth switching transistor has a gate connected to the third scan terminal, a source connected to the driving control terminal and a drain connected to the second light emitting control terminal.

14. The display apparatus of claim 9, wherein the first light emitting unit comprises a first driving transistor and a first light emitting diode; wherein the first driving transistor has a gate connected to the driving control terminal, a source connected to the first voltage input terminal and a drain connected to the first light emitting control terminal; and the first light emitting diode has a first electrode connected to the first light emitting control terminal and a second electrode connected to the second voltage input terminal;

the second light emitting unit comprises a second driving transistor and a second light emitting diode; wherein the second driving transistor has a gate connected to the driving control terminal, a source connected to the first voltage input terminal and a drain connected to the second light emitting control terminal; and the second light emitting diode has a first electrode connected to the second voltage input terminal and a second electrode connected to the second light emitting control terminal;

the first driving transistor and the second driving transistor are of different types.

15. The display apparatus of claim 14, wherein the first electrode of the first light emitting diode is an anode and the second electrode of the first light emitting diode is a cathode, and the first electrode of the second light emitting diode is an anode and the second electrode of the second light emitting diode is a cathode;

the first light emitting unit emits light during a preset high level period supplied between the first voltage terminal and the second voltage terminal, and the second light emitting unit emits light during a preset low level period supplied between the first voltage terminal and the second voltage terminal.

16. The display apparatus of claim 14, wherein the first electrode of the first light emitting diode is a cathode and the second electrode of the first light emitting diode is an anode, and the first electrode of the second light emitting diode is a cathode and the second electrode of the second light emitting diode is an anode;

the first light emitting unit emits light during a preset low level period supplied between the first voltage terminal and the second voltage terminal, and the second light emitting unit emits light during a preset high level period supplied between the first voltage terminal and the second voltage terminal.

17. A driving method of a pixel circuit, wherein the pixel circuit comprises: a first capacitor, a second capacitor, a voltage input unit, a data signal input unit, a first light emitting unit, a second light emitting unit and a light emitting control unit, wherein the driving method comprises:

during a first stage, controlling the voltage input unit to operate to supply a second input voltage at a second voltage terminal to the first light emitting unit and the second light emitting unit by aid of a first scan terminal, controlling the data signal input unit to operate to input a data line signal of a data line to the second capacitor by aid of a second scan terminal and controlling the light emitting control unit to operate by aid of a third scan terminal, such that voltage at a driving control terminal is reset;

during a second stage, controlling the voltage input unit to close by aid of the first scan terminal, controlling the data signal input unit to operate to input the data line signal of the data line to the second capacitor by aid of the second scan terminal and controlling the light emitting control unit to operate by aid of the third scan terminal, such that the first capacitor is charged by the first voltage terminal and the second capacitor is charged by the data line, wherein a first electrode of the first capacitor is connected to the first voltage terminal and a second electrode of the first capacitor is connected to the driving control terminal; and a first electrode of the second capacitor is connected to the data signal input unit and a second electrode of the second capacitor is connected to the driving control terminal;

during a third stage, controlling the voltage input unit to close by aid of the first scan terminal, controlling the data signal input unit to operate to input the data line signal of the data line to the second capacitor by aid of the second scan terminal and controlling the light emitting control unit to close by aid of the third scan terminal, such that a voltage transition is generated at the driving control terminal by a voltage transition at the data line due to the coupling effect of the second capacitor;

during a fourth stage, controlling the voltage input unit to operate to supply the second input voltage at the second voltage terminal to the first light emitting unit and the second light emitting unit by aid of the first scan terminal, controlling the data signal input unit to close by aid of the second scan terminal and controlling the light emitting control unit to close by aid of the third scan terminal, such that the first light emitting unit is driven to emit light by aid of the driving control terminal, a first light emitting control terminal, a first voltage input terminal and a second voltage input terminal, wherein the first voltage input terminal is configured to supply a first input voltage at a first voltage terminal to the first light emitting unit and the second light emitting unit;

during a fifth stage, controlling the voltage input unit to operate to supply the second input voltage at the second voltage terminal to the first light emitting unit and the second light emitting unit by aid of the first scan terminal, controlling the data signal input unit to operate to input the data line signal of the data line to the second capacitor by aid of the second scan terminal and controlling the light emitting control unit to operate by aid of the third scan terminal, such that the voltage at the driving control terminal is reset;

during a sixth stage, controlling the voltage input unit to close by aid of the first scan terminal, controlling the data signal input unit to operate to input the data line signal of the data line to the second capacitor by aid of the second scan terminal and controlling the light emitting control unit to operate by aid of the third scan terminal, such that the first capacitor is charged by the first voltage terminal and the second capacitor is charged by the data line;

during a seventh stage, controlling the voltage input unit to close by aid of the first scan terminal, controlling the data signal input unit to operate to input the data line signal of the data line to the second capacitor by aid of the second scan terminal and controlling the light emitting control unit to close by aid of the third scan terminal, such that a voltage transition is generated at the driving control terminal by a voltage transition at the data line due to the coupling effect of the second capacitor; and during an eighth stage, controlling the voltage input unit to operate to supply the second input voltage at the second voltage terminal to the first light emitting unit and the second light emitting unit by aid of the first scan terminal, controlling the data signal input unit to close by aid of the second scan terminal and controlling the light emitting control unit to close by aid of the third scan terminal, such that the second light emitting unit is driven to emit light by aid of the driving control terminal, a second light emitting control terminal, the first voltage input terminal and the second voltage input terminal.

18. The driving method of claim 17, wherein the light emitting control unit comprises a first switching transistor having a gate connected to the third scan terminal, a source connected to the driving control terminal, and a drain connected to the first light emitting control terminal and the second light emitting control terminal;

the voltage input unit comprises a second switching transistor having a gate connected to the first scan terminal, a source connected to the second voltage terminal, and a drain connected to the second voltage input terminal;

the data signal input unit comprises a third switching transistor having a gate connected to the second scan terminal, a source connected to the data line, and a drain connected to the first electrode of the second capacitor;

the first light emitting unit comprises a first driving transistor and a first light emitting diode; wherein the first driving transistor has a gate connected to the driving control terminal, a source connected to the first voltage input terminal and a drain connected to the first light emitting control terminal; and the first light emitting diode has a first electrode connected to the first light emitting control terminal and a second electrode connected to the second voltage input terminal;

the second light emitting unit comprises a second driving transistor and a second light emitting diode; wherein the second driving transistor has a gate connected to the driving control terminal, a source connected to the first voltage input terminal and a drain connected to the second light emitting control terminal; and the second light emitting diode has a first electrode connected to the second voltage input terminal and a second electrode connected to the second light emitting control terminal; the first driving transistor and the second driving transistor are of different types, in the method, during the first stage, the first switching transistor, the second switching transistor, the third switching transistor and the first driving transistor are turned on, and the second driving transistor is turned off;

during the second stage, the first switching transistor, the third switching transistor and the first driving transistor are turned on, and the second switching transistor and the second driving transistor are turned off;

during the third stage, the first switching transistor and the second switching transistor are turned off, the third switching transistor is turned on, and the first driving transistor and the second driving transistor are in an open-circuit state;

during the fourth stage, the first switching transistor, the third switching transistor and the second driving transistor are turned off, and the second switching transistor and the first driving transistor are turned on;

during the fifth stage, the first switching transistor, the second switching transistor, the third switching transistor and the second driving transistor are turned on, and the first driving transistor is turned off;

during the sixth stage, the first switching transistor, the third switching transistor and the second driving transistor are turned on, and the second switching transistor and the first driving transistor are turned off;

during the seventh stage, the first switching transistor and the second switching transistor are turned off, the third switching transistor is turned on, and the first driving transistor and the second driving transistor are in an open-circuit state; and during the eighth stage, the first switching transistor, the third switching transistor and the first driving transistor are turned off, and the second switching transistor and the second driving transistor are turned on.

19. The driving method of claim 17, wherein the light emitting control unit comprises a first switching transistor and a fourth switching transistor; the first switching transistor has a gate connected to the third scan terminal, a source connected to the driving control terminal and a drain connected to the first light emitting control terminal; and the fourth switching transistor has a gate connected to the third scan terminal, a source connected to the driving control terminal and a drain connected to the second light emitting control terminal;

the voltage input unit comprises a second switching transistor having a gate connected to the first scan terminal, a source connected to the second voltage terminal, and a drain connected to the second voltage input terminal;

the data signal input unit comprises a third switching transistor having a gate connected to the second scan terminal, a source connected to the data line, and a drain connected to the first electrode of the second capacitor;

the first light emitting unit comprises a first driving transistor and a first light emitting diode; wherein the first driving transistor has a gate connected to the driving control terminal, a source connected to the first voltage input terminal and a drain connected to the first light emitting control terminal; and the first light emitting diode has a first electrode connected to the first light emitting control terminal and a second electrode connected to the second voltage input terminal;

the second light emitting unit comprises a second driving transistor and a second light emitting diode; wherein the second driving transistor has a gate connected to the driving control terminal, a source connected to the first voltage input terminal and a drain connected to the second light emitting control terminal; and the second light emitting diode has a first electrode connected to the second voltage input terminal and a second electrode connected to the second light emitting control terminal; the first driving transistor and the second driving transistor are of different types, in the method, during the first stage, the first switching transistor, the second switching transistor, the third switching transistor and the first driving transistor are turned on, and the second driving transistor is turned off;

during the second stage, the first switching transistor, the third switching transistor and the first driving transistor are turned on, and the second switching transistor and the second driving transistor are turned off;

during the third stage, the first switching transistor and the second switching transistor are turned off, the third switching transistor is turned on, and the first driving transistor and the second driving transistor are turned off;

during the fourth stage, the first switching transistor, the third switching transistor and the second driving transistor are turned off, and the second switching transistor and the first driving transistor are turned on;

during the fifth stage, the first switching transistor, the second switching transistor, the third switching transistor and the second driving transistor are turned on, and the first driving transistor is turned off;

during the sixth stage, the first switching transistor, the third switching transistor and the second driving transistor are turned on, and the second switching transistor and the first driving transistor are turned off;

during the seventh stage, the first switching transistor and the second switching transistor are turned off, the third switching transistor is turned on, and the first driving transistor and the second driving transistor are turned off; and during the eighth stage, the first switching transistor, the third switching transistor and the first driving transistor are turned off, and the second switching transistor and the second driving transistor are turned on;

the method further comprises:

during the first stage, the fourth switching transistor is turned on;

during the second stage, the fourth switching transistor is turned on;

during the third stage, the fourth switching transistor is turned off;

during the fourth stage, the fourth switching transistor is turned off;

during the fifth stage, the fourth switching transistor is turned on;

during the sixth stage, the fourth switching transistor is turned on;

during the seventh stage, the fourth switching transistor is turned off; and during the eighth stage, the fourth switching transistor is turned off.

* * * * *